US005477307A

United States Patent [19]

Bergen et al.

[11] Patent Number: 5,477,307

[45] Date of Patent: Dec. 19, 1995

[54] APPARATUS FOR DISPERSING AND/OR TRANSPORTING PARTICULATES

[75] Inventors: George F. Bergen, Penfield; Richard H. Dennie, Macedon; Gary A. Denton, Webster; David R. Jenkins, Penfield; James M. Pacer, Webster, all of N.Y.

[73] Assignee: Xerox Corporation, Stamford, Conn.

[21] Appl. No.: 306,070

[22] Filed: Sep. 14, 1994

[51] Int. Cl.[6] ..... G03G 15/08

[52] U.S. Cl. ..... 355/245; 355/260; 222/DIG. 1; 222/200

[58] Field of Search ..... 355/245, 253, 355/260; 118/653, 656, 657, 658; 222/DIG. 1, 199, 200

[56] References Cited

U.S. PATENT DOCUMENTS

| | | | |
|---|---|---|---|
| 3,528,386 | 9/1970 | Morine | 118/7 |
| 3,621,816 | 11/1971 | Donalies | 118/637 |
| 3,654,900 | 4/1972 | Yang | 118/637 |
| 3,655,033 | 4/1972 | Lynch et al. | 198/220 BC |
| 3,692,403 | 3/1972 | Turner | 355/3 |
| 3,941,470 | 3/1976 | Shah | 355/3 DD |
| 3,974,944 | 8/1976 | Takeuchi | 222/200 X |
| 4,023,527 | 5/1977 | DeMayo | 118/655 |
| 4,078,520 | 3/1978 | Wilson | 118/646 |
| 4,113,371 | 9/1978 | Fraser et al. | 355/4 |
| 4,436,411 | 3/1984 | Miyoshi | 118/653 X |
| 4,498,635 | 2/1985 | Fielding | 222/200 X |
| 4,561,759 | 12/1985 | Knott | 222/200 X |
| 5,019,870 | 5/1991 | Bares | 355/298 |
| 5,095,341 | 3/1992 | Yoshida et al. | 355/259 |
| 5,233,393 | 8/1993 | Yoshida et al. | 355/271 |
| 5,239,346 | 8/1993 | Corbin et al. | 355/260 |
| 5,257,077 | 10/1993 | Peters et al. | 355/260 |
| 5,260,746 | 11/1993 | Yoshida et al. | 355/245 |
| 5,307,128 | 4/1994 | Murasaki et al. | 355/260 |
| 5,341,939 | 8/1994 | Aitchison et al. | 209/319 |

*Primary Examiner*—R. L. Moses

[57] ABSTRACT

An apparatus for dispersing and/or transporting/migrating particles such as toner that may be prone to agglomeration in a particle dispensing system. Movement and/or vibration of the dispersing and migrating plate member serves to break up, clear and prevent particle agglomerations. Perforations, slits or mesh areas in the upper surface of the plate member can prevent oversize particles/agglomerations from passing through the system, while side walls, fins or disposing the plate member at a angle can channelize the dispersion of the particles contacting the upper surface of the plate member.

29 Claims, 4 Drawing Sheets

APPARATUS FOR DISPERSING AND/OR TRANSPORTING PARTICULATES

The present invention relates to an apparatus for use in, for example, a toner supply dispenser such as in a xerographic copier or printer. More specifically, the present invention relates to such an apparatus which disperses and transports toner dispensed into a developer housing.

In electrophotographic applications such as xerography, a charge retentive surface is electrostatically charged, and then exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner." Toner is held on the image areas by the electrostatic charge on the surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens or digital copying from an original or printing electronically generated or stored originals, where a charged surface may be imagewise discharged in a variety of ways.

Developing material commonly used in systems for developing latent images on the charge retentive surface typically comprises a mixture of toner and a "carrier" of larger granular beads of a ferrous material. If the developing system includes a magnetic brush assembly, magnetizable carrier beads also provide mechanical control for the formation of magnetic brush bristles so that toner can readily be brought into contact with the charge retentive surface. Toner is attracted to the latent image from the carrier beads to form the toner image.

In certain types of electrophotographic printers, particularly those of the "high-volume" or "mid-volume" variety, it is common to provide an external supply of pure toner, which is gradually introduced into the toner-carrier mixture forming the developer as toner is depleted from the toner-carrier mixture in the course of use. This pure toner supply is typically in the form of a separately-purchasable toner bottle. When handled in bulk, toner particles require careful flow control in order to avoid problems such as leakage, clumping, or clogging of the toner supply. Ordinarily, toner comprises very fine particles in combination with a flow agent, and thus flows readily from even the smallest cracks in a toner supply system. Simultaneously, various temperature and humidity conditions may cause toner particles to clump or agglomerate, within a toner supply, thus disturbing the desired constant flow of toner into a system. Such agglomerated toner may then clog or "bridge," between internal surfaces or areas of a toner dispensing system.

In a large system, it is desirable to know whether there is an appreciable quantity of toner present at any given point along the toner supply and dispensing system, and to add toner to the system when appropriate. For detecting the presence of toner in a certain location, various types of sensors are well known in the prior art. For example, optical sensors, in which the opacity or light-absorptive qualities of toner are exploited, are known, as are magnetic detectors which are useful in those systems wherein the toner is designed to have a magnetic property associated therewith. Another type of toner sensor which has recently found favor is the vibrational sensor. In such a sensor, These changes in characteristics may be detected electronically, and may be used to control the system or indicate to the user that, for example, the external toner supply bottle is empty. One type of vibrational sensor, made by Motorola, Inc., of Albuquerque, N. Mex., comprises a sandwiched ceramic piezoelectric member, generally forming a plane approximately 1 centimeter square, which forms a "fin" which is intended to extend into a cavity of a container for toner particles. When the cavity is full of toner particles and the fin is thus substantially in contact with toner particles, the fin will vibrate in one detectable way (such as at one frequency), and when the container is empty of toner particles, the fin will be caused to vibrate in another detectable way (such as at another frequency). While such a vibrating fin may enhance sensor operations, it has no effect on other toner agglomeration problems in a copier or printer.

Certain products currently commercially available which include this type of vibrational detector are the Xerox Corporation Models No. 5100, as well as certain of the models No. 4850 or "DocuTech" (a trademark of Xerox Corporation) and many other machines. Another Xerox product, the 813 copier, includes a toner dispensing system in which a plate having discharge passages uses wires which move/vibrate once with each copy toner for dispensing toner particles from a hopper (which also vibrates). Other common configurations have a toner bottle oriented so that toner will pour by gravity into an opening adjacent to a rotating auger which in turn is used to distribute toner particles along a length of a developer housing, as is known in the art. The above-mentioned Xerox Corporation products and others often employ systems wherein toner particles negotiate a narrow path from the toner supply bottle through a port to an auger, and further out of a set of ports aligned across the width of the developer housing. It has been found that agglomeration or clumping of toner particles dispensed in a stream to fall from this set of metering ports can occur, potentially causing print defects such as streaking or cometing. These problems are generally manifested by the formation of spots or steaks on the copy or print sheet in background or less than fully toned areas, greatly detracting from the quality of the final produced image.

Various approaches have been employed to sift, screen, move or sort particles in addition to the sensor devices described above, including the following disclosures that may be relevant:

U.S. Pat. No. 5,341,939

Patentee: Aitchison et al

Issued: Aug. 30, 1994

U.S. Pat. No. 5,307,128

Patentee: Murasaki et al

Issued: Apr. 26, 1994

U.S. Pat. No. 5,260,746

Patentee: Yoshida et al

Issued: Nov. 9, 1993

U.S. Pat. No. 5,233,393

Patentee: Yoshida et al

Issued: Aug. 3, 1993

U.S. Pat. No. 5,095,341

Patentee: Yoshida et al

Issued Mar. 10, 1992

U.S. Pat. No. 5,019,870

Patentee: Bares

Issued: May 28, 1991

U.S. Pat. No. 4,113,371

Patentee: Fraser et al

Issued: Sep. 12, 1978

U.S. Pat. No. 4,078,520

Patentee: Wilson

Issued Mar. 14, 1978

U.S. Pat. No. 3,941,470

Patentee: Shah

Issued Marc. 2, 1976

U.S. Pat. No. 3,692,403

Patentee: Turner

Issued: Sep. 19, 1972

U.S. Pat. No. 3,655,033

Patentee: Lynch et al

Issued Apr. 11, 1972

U.S. Pat. No. 3,654,900

Patentee: Yang

Issued: Apr. 11, 1972

U.S. Pat. No. 3,621,816

Patentee: Donalies

Issued: Nov. 23, 1971

U.S. Pat. No. 3,528,386

Patentee: Morine

Issued: Sep. 15, 1970

U.S. Pat. No. 5,341,939 discloses a vibrating multi-level device for screening materials. Independently framed vibrating screen decks are angled and used to separate the various sized materials; material guides are provided between screen decks.

U.S. Pat. No. 5,307,128 discloses a toner supplying device for supplying toner to a developing device in an electrophotographic image forming apparatus comprising a toner hopper for containing and feeding new toner, a recycle device for introducing toner from a cleaner which collects residual toner on an electrostatic latent image carrying member to an outlet of the hopper or the vicinity thereof, a toner agitating chamber opposed to the outlet of the hopper and an outlet of the recycle device, a toner agitating member disposed in the toner agitating chamber, and a toner feeder for feeding the toner from the toner agitating chamber to the developing device.

U.S. Pat. Nos. 5,260,746, 5,233,393 and 5,095,341, 5,019,870 disclose the measurement or testing of toner fluidity which includes the vibration of toner through a series of #200, # 100 and #60 mesh screens, and thereafter measuring residual toner on the #100 and #60 mesh screens.

U.S. Pat. No. 5,019,870 discloses an apparatus in which developer material is transported to the latent image. Toner particles are attracted from the carrier granules of the ;developer material to the latent image. The developer material is in a chamber of a housing and additional toner particles are supplied thereto. Undersized toner particles are removed from the chamber of the housing through a screen using a charged brush.

U.S. Pat. No. 4,113,371 discloses a development apparatus in which a plurality of differently colorer particles are dispensed into a common sump. Differently colored particles are dispensed in a pre-selected ratio by vibrating a toner containers holding different colored toners. The toner containers have floor perforations so as to meter particles into the the sump by shaking the container, so as to form a resultant mixture of particles in the sump having a pre-selected color. This mixture is subsequently deposited on a latent image rendering the image visible in the pre-selected color.

U.S. Pat. No. 4,078,520 discloses a vibrating screen covering a toner density measuring sensor to prevent the sensor from clogging.

U.S. Pat. No. 3,941,470 discloses an apparatus in which a quantity of particles is stored and gradually dispensed to a mix thereof. A plate having discharge passages moves to dispense toner particles from a hopper. Bridging and caking of the particles is prevented by forming grooves and moving a dispenser plate under the hopper itself each time a document is printed, thus providing an amount of toner for forming a toned image on a photoreceptor.

U.S. Pat. No. 3,655,033 discloses a toner feed mechanism for use in xerographic reproduction apparatus. The mechanism is characterized by the provision of a container and a structure for vibrating the container so that the toner moves up an internal spiral ramp to an outlet from which the toner phases from the container to a vertically disposed conduit communicating therewith. A screen is provided at the transition between the container and the conduit to prevent passage of irregularly shaped chips which serve to optimize the: movement of toner to the outlet and to effect return of the chips to a sump area in the container.

U.S. Pat. No. 3,654,900 discloses a latent electrostatic image effected by vibrating a mass of two-component developer on a support surface to maintain the developer mass in a fluidized state in close proximity to a latent electrostatic image bearing surface whereby toner is attracted to image areas to effect development thereof. The toner is replenished by passing toner from a suitable toner supply, such as a toner powder cloud, through apertures in the supporting surface which are larger than the toner particles and smaller than the carrier particles, whereby an adequate toner supply is maintained in the; development zone without recirculating the carrier.

U.S. Pat. No. 3,692,403 discloses a reciprocating gate toner dispenser having an override control for manually selecting toner concentrations in a xerographic imaging system to prevent overtoning. A drive mechanism responsive to copy production incrementally moves a toner metering element having slots/wires for pushing toner to openings for dispensing.

U.S. Pat. No. 3,621,816 discloses an apparatus for developing a latent electrostatic image wherein the developer material is circulated in a highly mobile manner past the image bearing surface. The high mobility of the developer is achieved by the use of interlaced vibrating electrode members wherein the relative movement thereof causes developer material to be circulated about an inner electrode means thereby achieving a high degree of circulation of the carrier material in the developer. The high degree of circulation particles alleviates the problem of sticking of the carrier material to the image bearing surface and overcomes insufficient leading edge development of solid image areas.

U.S. Pat. No. 3,528,386 discloses an apparatus for dispensing particulate material in a predetermined pattern onto a subjacent surface. The apparatus includes a frame which resiliently supports a material holding hopper with its bottom wall above and facing the subjacent surface. The bottom wall of the hopper is open in the predetermined pattern and a reticulated means, preferably wire mesh, is connected across the open pattern. The openings in the reticulated means are sized so as to be only slightly larger than the average maximum cross-section of the material particles. Additionally, selectively actuatable power means are arranged to impart a relatively high frequency, short amplitude vibration to the hopper. The openings in the mesh are selected so that the material will not pass through the mesh until the hopper is vibrated. This, in effect, provides a valving action without the complexity and limitations inherent in standard valve structures.

According to one aspect of the present invention, there is provided a developer housing including an apparatus for dispersing particles metered from a hopper and falling in a stream, including a movable plate positioned below the stream of particles and having an upper surface for contacting the particles and a means operatively associated with the plate for moving the plate so as to disperse the particles contacting the plate relative to a direction perpendicular to the stream of falling particles.

According to another: aspect of the present invention, there is provided a printing machine having a developer housing including an apparatus for dispersing particles metered from a hopper and falling in a stream, including a movable plate positioned below the stream of particles and having an upper surface for contacting the particles and a means operatively associated with the plate for moving the plate so as to disperse the particles contacting the plate relative to a direction perpendicular to the stream of falling particles.

The invention will be described in detail with reference to the following drawings, in which like reference numerals are used to refer to like elements. The various aspects of the present invention will become apparent as the following description proceeds and upon reference to the drawings, in which.

While the present invention will hereinafter be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 4:
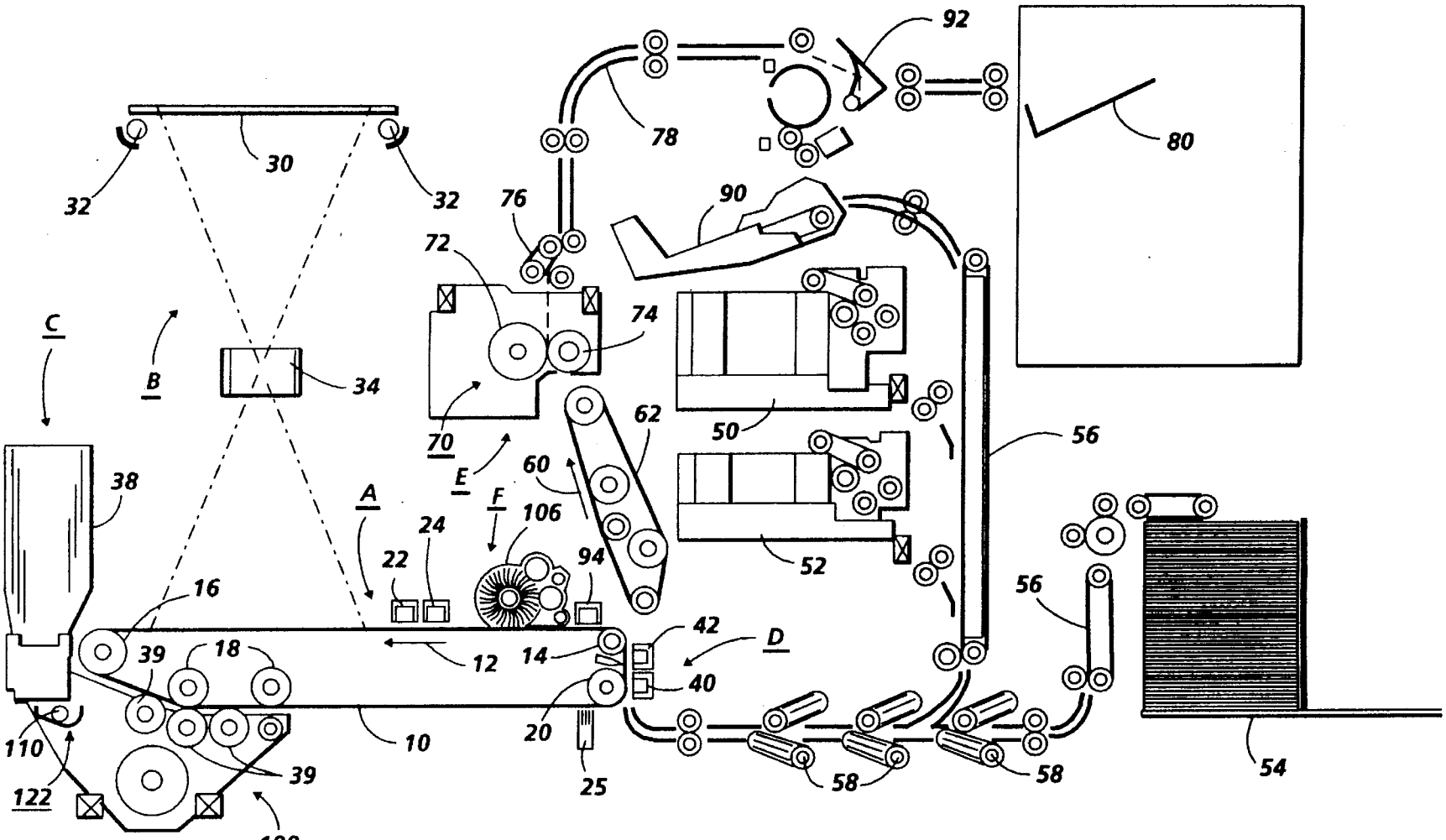
FIG. 4 is a simplified elevational view showing the primary components of a typical commercially available electrophotographic printer, incorporation aspects of the present invention.

Referring now to the drawings, for the purpose of describing a preferred embodiment of the invention and not for limiting same, the various processing stations employed in the reproduction machine illustrated in FIG. 4 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Photoreceptor belt 10 is entrained about stripping roller 14, tension roller 16, idler rollers 18, and drive roller 20. Drive roller 20 is coupled to a motor (not shown) by suitable means such as a belt drive. Photoreceptor belt 10 is maintained in tension by a pair of springs (not shown) resiliently urging tension roller 16 against belt 10 with the desired spring force. Both idler rollers 18 and tension roller 16 are rotatably mounted. These rollers are idlers which rotate freely as belt 10 moves in the direction of arrow 12. Belt 10, in combination with stripping roller 14, tension roller 16, idler rollers 18, and drive roller 20, forms a "photoreceptor assembly" which, in a typical commercially made copier, may be formed on a pivoting assembly for convenience in servicing.

Figure 1:
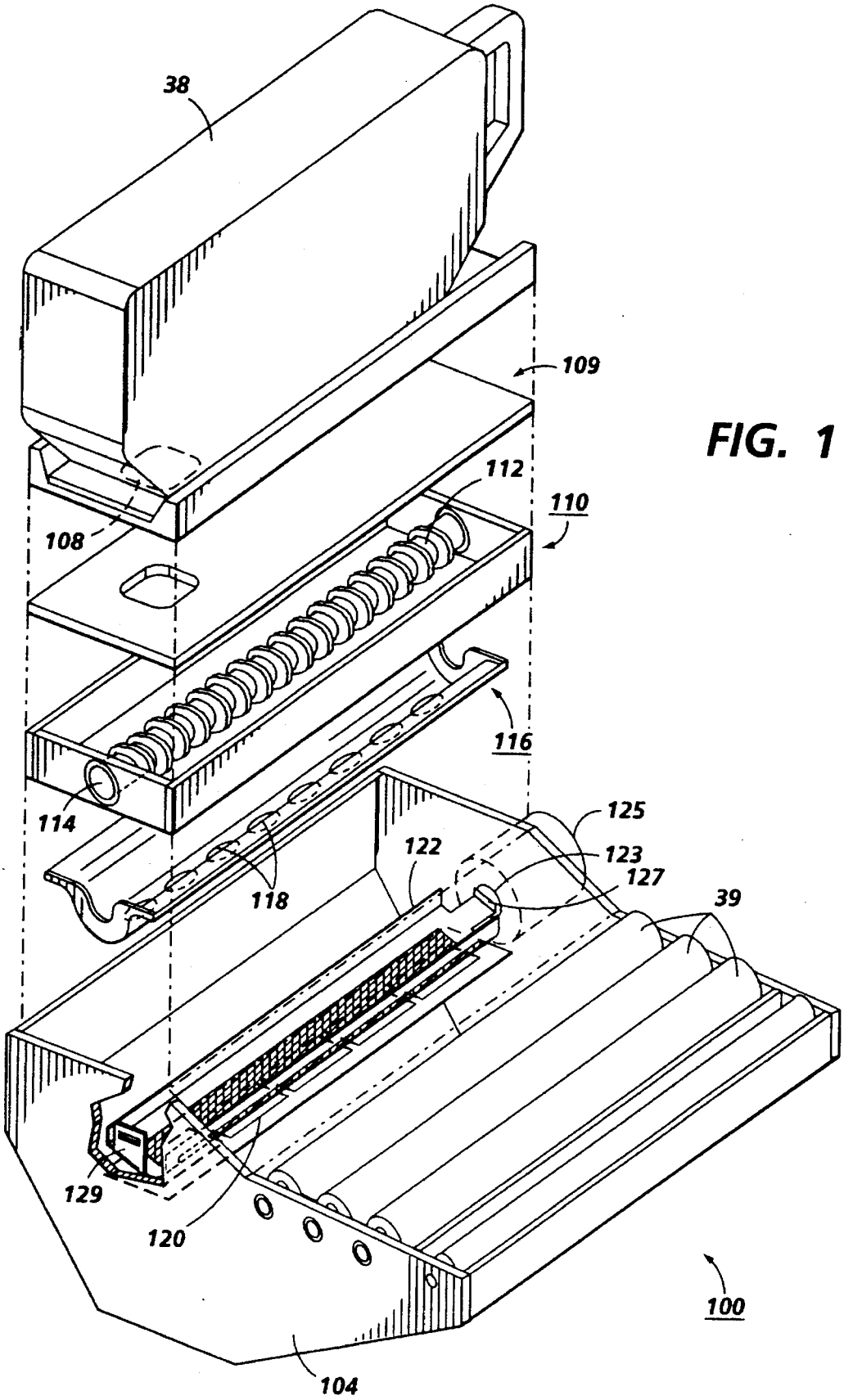
FIG. 1 is an elevational view of a portion of a developer unit as would be used in an electrophotographic copier or printer such as that shown in FIG. 4.

With continued reference to FIG. 1, initially a portion of belt 10 passes through charging station A. At charging station A, a pair of corona devices 22 and 24 charge photoreceptor belt 10 to a relatively high, substantially uniform negative potential. The edge of the photoreceptor belt 10 is typically grounded by a ground brush 25, which is used as part of a "closed-loop" charging system.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, photoreceptor belt 10 advances the electrostatic latent image to development station C. At development station C, a magnetic brush developer unit generally indicated as 100 advances a developer mix (i.e. toner and carrier particles, also known as carrier beads) into contact with the electrostatic latent image with magnetic brushes 39. Pure toner to be gradually introduced into the toner-carrier mix forming the developer mix is stored in a toner bottle 38, which is typically in the form of a 1–2 gallon plastic bottle which is inverted to discharge pure toner into the developer unit 100 as needed. An auger assembly 110 is positioned below bottle 38, and drops toner into toner dispersing and migrating member 122 of the present invention, as described in greater detail in association with Figure. Rollers 39 transport and mix developer (toner particles and carrier granules). The latent image attracts toner particles from the carrier granules, thereby forming toner powder images on photoreceptor belt 10.

Photoreceptor belt 10 then advances the developed latent image to transfer station D. At transfer station D, a sheet of support material such as paper copy sheet is moved into contact with the developed latent images on belt 10. First, the latent image on belt 10 is exposed to a pre-transfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet from belt 10, whereupon the sheet is stripped from belt 10 at stripping roller 14.

Sheets of substrate or support material are advanced to transfer station D from supply trays 50i 52 and 54, which may hold different quantities, sizes and types of support materials. Sheets are advanced to transfer station D along conveyors 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc., and removal from the machine by the operator. Alternatively, the sheet may be advanced to a duplex tray 90 from duplex gate 92 from which it will be returned to the processor and conveyor 56 for receiving second side copy.

A pre-clean corona generating device 94 may be provided for exposing the residual toner and contaminants to positive charges to thereby narrow the charge distribution thereon for more effective removal at rotating electrostatic brush 106 and cleaning station F.

As thus described, a reproduction machine in accordance with the present invention may be any of several well known devices. Variations may be expected in specific electrophotographic processing, paper handling and control arrangements without affecting the present invention.

FIG. 1 is a detailed view of the location of developer unit 100 where toner bottle 38, which is inverted to be neck-down, causes toner to be discharged into developer unit 100. Such an arrangement is seen, for example, in the Xerox Corporation Models mentioned above. Bottle 38 opens into a a rotating auger, such as are well known in the art of developer units, and function to distribute incoming toner in the inboard-outboard directions in a developer housing, so that the developer mix will not be caused to overconcentrate toner at one portion of the developer housing at the expense of another. The developer mix in the developer unit is eventually "picked up" by, for example, a magnetic developer, mixing or movement rolls such as rollers for conveyance to or from the latent image on the photoreceptor, as is well known in the art of xerography.

FIG. 1 shows an exploded view of a developer housing 100 embodying aspects of the present invention. Main toner hopper 38 is shown with a dispense hole 108, out of which an auger assembly 110 is positioned. Spiraling auger blade 112 is shown mounted on shaft 114, for pulling toner from dispensing port 108. An upper cover 109 overlies auger blade 110, while lower cover 116 underlies auger assembly 112. A toner dispersing and migrating member 122 underlies these dispensing ports 118. As auger blade 112 pulls toner from port 108 of hopper 38, toner is metered from dispensing ports 118 in lower cover 116 across the length of the developer housing (inboard-outboard direction) and in the width (process direction) of screened/perforated portion of the toner dispersing and migrating member 122. Member 122 is shown mounted in one embodiment at one end with a flexible hanging member 129, suspended from a hanging point (not shown) in the side of lower developer housing portion 104. At the opposite end a connector 127 joins member 122 to a linear motor 125 through hole 123 at the opposite end of member 122. In one embodiment, motor 125 moves member 122 in a back and forth motion across the width of developer housing 100, preventing agglomerated toner clumps or balls from passing directly from toner dispensing ports 118 into lower housing 104 ports 120. In a preferred embodiment, a linear drive mechanism such as that incorporated into the Model AM-3 air pump manufactured by Apollo Enterprises, Inc., which like other embodiments may be powered by 120 vac already available from a power supply source (not shown) in the vicinity of developer 100 to impart movement to member 122 across the width of developer 100. The fresh toner dispensed from hopper 38 is thereby dispersed and transported/migrated into position in the inboard-outboard and process directions in developer housing 100 so as to be used to replenish toner levels in developer 100, such as transported by rollers 39. Various other embodiments of the toner dispensing and migrating member and the associated motivating devices are described in greater detail in association with FIGS. 2A through 2D and FIGS. 3A through 3D below.

Figure 2A:
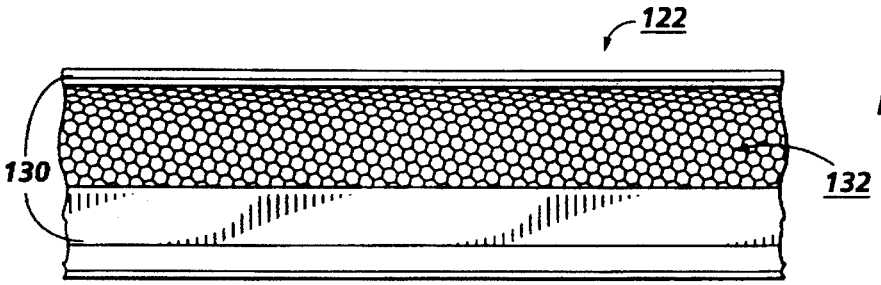
FIG. 2A is a top view of a toner dispersing and migrating member of the present invention shown in isolation.

FIG. 2A shows toner dispensing and migrating member 122 in isolation, with masked areas 130 preventing toner from spilling off of the lead and trail edges of member 122. Member 122 is further shown with a honeycomb structure of perforations 132 in the dispensing zone of member 122. The motion of member 122 prevents toner agglomerations or clumps much smaller than honeycomb perforations 132 from passing through member 122. (FIG. 3D shows another toner dispensing and migrating member 198 with a similar cross-sectional structure as member 122 shown in FIG. 2A, in which toner particles 210 are dispersed and migrated into the desired entry position over the entire area of ports 120.)

Figure 2B:
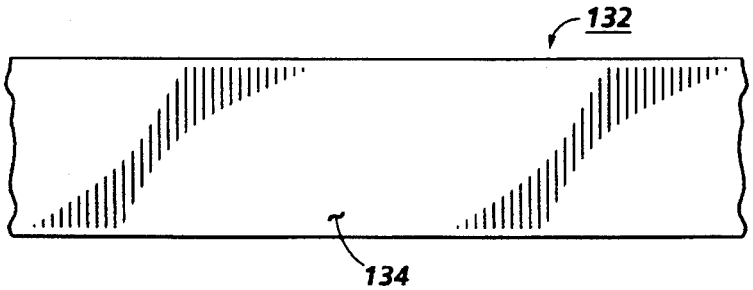
FIG. 2B is a top view of another embodiment of the toner dispersing and migrating member of the present invention, shown in isolation.

FIG. 2B shows another embodiment of a toner dispensing and migrating member 132, in which a planar surface 134 (without perforations) to disperse and migrate toner to a desired dispensing position off of a forward or lead edge of planer surface 134. As particles fall onto member 132, its movement and or vibration gently cause clumps of toner to disperse. The movement of member 132 prevents particle pile-up or bridging. When one edge of moving member 132 is lower than the other (such as shown by the angled perforated portion 198 of member 192 as shown in. FIG. 3D), particles can be directed to fall only off of that lower edge.

Figure 2C:
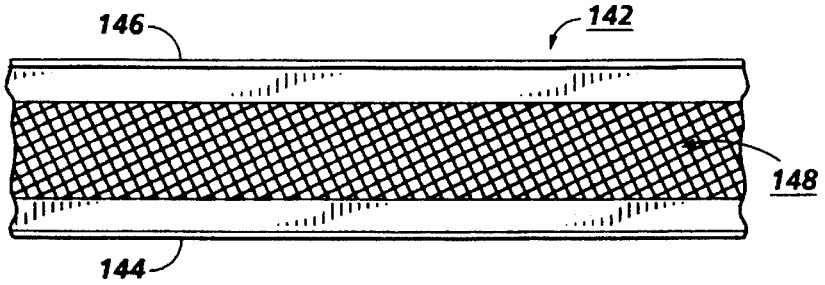
FIG. 2C is a top view of another embodiment of the toner dispersing and migrating member of the present invention, shown in isolation.

FIG. 2C shows another embodiment of member 142 in which sidewalls 144 and 146 and accompanying masked portions are used to migrate and disperse toner toward the center of member 142, such as may be dispensed through the zone of screen area 148. (FIG. 3C shows a side view of another embodiment of a member 182 in this case using a screen area 189 and sidewalls 186, which is shaped like member 142.)

Figure 2D:
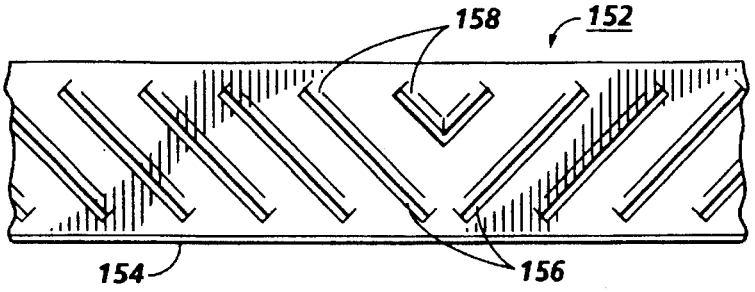
FIG. 2D is a top view of another embodiment of the toner dispersing and migrating member of the present invention, shown in isolation.

FIG. 2D shows another embodiment of a toner migrating and dispersing member 152 which includes a wall 154 for preventing toner from spilling from one edge of member 152. Member 152 includes open slit areas 158, from which toner directing fins 156 are folded upwards from the surface of member 152. In this manner, a pattern of slits 158 and fins 156 can migrate and channelize toner in an angular direction away from each toner dispensing port 118 as shown in FIG. 1. (FIG. 3B shows a side view of another embodiment of a member 172, which is shaped like member 152, without slits 158 and fins 156.)

Figure 3A:
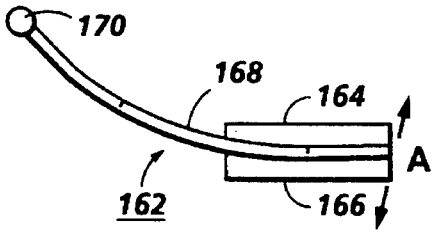
FIG. 3A is an elevational view of a toner dispersing and migrating member and system of the present invention.

FIG. 3A shows an end profile of a toner dispersing and migrating member 162, which may in alternative embodiments include solid portions, screen holes, fins, slit, honeycomb perforations or other dispensing areas as previously described in association with FIGS. 2A through 2D. FIG. 3A shows an end view of an embodiment of toner dispersing and migrating member 162 which includes one or more piezoelectric elements for creating the desired motion and vibration to migrate and disperse toner. A flexible insulating layer 168, typically made of a ceramic material is coupled with an electrode structure (described below) causes to vibration at a certain frequency while portions of member 162 are in contact with toner particles. The vibrational characteristics of the member 162 will vary depending on whether the vibrating member is in contact with an appreciable amount of toner particles. When there are very few toner particles in contact with the vibrating member 162, such as when the particular location is substantially empty of toner particles, the vibrating member 162 will assume a characteristic vibrational behavior, different from that in the case where the member is vibrating against a mass of toner particles. A rigid rod 170 is shown in end view attached at one edge of flexible insulating layer 168 of vibrating member 162. An upper conductive member 164 overlies flexible insulating layer 168 while a lower conductive member 166 underlies flexible insulating layer 168. Each end of rigid rod 170 is affixed to the side walls of lower developer housing portion 104, on place of motor 125, member 122, connector 127 and hanger 129 as shown in FIG. 1. A voltage is alternatingly applied across upper conductive member 164 and lower conductive member 166 by power source wires (not shown), causing the entire member 162 to oscillate or vibrate generally in the direction of arrows "A" as shown. As member 162 to vertically oscillates, toner agglomerations and particles are dispersed as they impact member 162, and are transported/migrated off of the the lower edge of member 162 into ports 120 (as shown in FIG. 1).

Figure 3B:
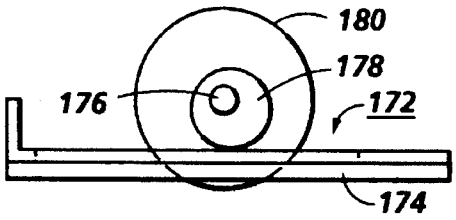
FIG. 3B is an elevational view of a another embodiment of the toner dispersing and migrating member and system of the present invention.
Figure 3C:
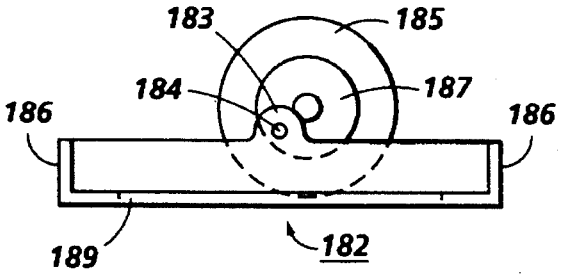
FIG. 3C is an elevational view of a another embodiment of the toner dispersing and migrating member and system of the present invention.
Figure 3D:
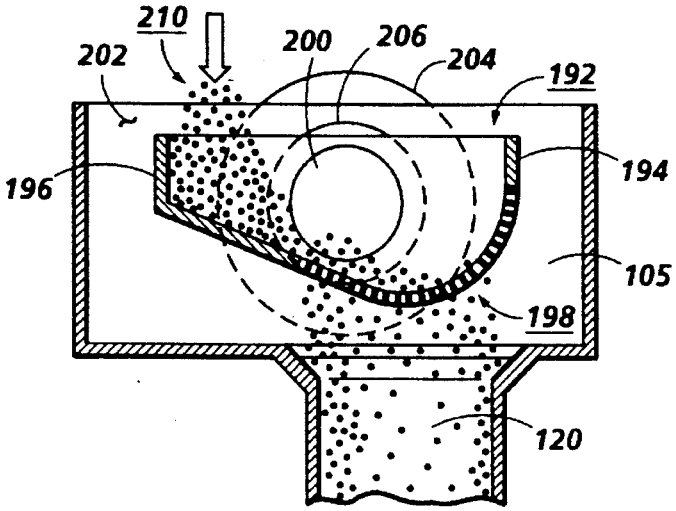
FIG. 3D is an elevational view of a another embodiment of the toner dispersing and migrating member and system of the present invention.

FIG. 3B shows an end view of another embodiment of toner dispersing and migrating member 172 which includes a motor 180, shaft 176 and elliptical cam 178 for impacting the upper surface member 172. As shaft 176 of motor 180, eccentric/elliptical cam 178 rotates so as to move into and out of contact with the upper surface of member 172, thus imparting the vibration to migrate and disperse agglomerations and individual toner particles dispensed onto the upper surface of member 172. Elastomeric support 174 supports the end of member 182, while permitting vertical and other vibrational movement of member 182.

FIG. 3C shows an end view of another embodiment of the toner dispersing and migrating member of the present invention. Member 182 includes a screened area 189 and sidewalls 186. Sidewalls 186 preventing toner from spilling from the front and rear edges of member 182. A motor 180 rotates flywheel 186. A pivot 184 connects arm 183 of member 182 to flywheel 187; as motor 185 rotates flywheel 187, thus imparting a circular motion to member 182 so as to migrate and disperse agglomerations and individual toner particles dispensed onto the upper surface of member 182.

FIG. 3D shows another embodiment of the toner dispersing and migrating member of the present invention. In this embodiment, member 192 includes a wall and masked area 196 and a wall area 194 for preventing toner from spilling from the front and rear edges of member 192. Toner particles and agglomerations fall into member 192. Perforated area 198 permits toner to be dispersed in all directions while in aggregate migrating toner in the direction of arrow B shown into ports 120 In this embodiment, a permanent magnet 200 is mounted at one end of member 192. Motor 204 includes a reversible field coil 206, mounted on the opposite side of developer housing wall 105. In this manner, inboard-outboard motion is imparted to member 192 without the need for a hole in housing wall 105, thus preventing any leakage or spillage of toner from lower housing 104. This embodiment, in addition to others described herein, is particularly useful as a retrofit to counteract the print defects that can occur as a result of undispersed toner agglomerations. As shown in FIG. 3D, toner particles/agglomerations 210 are dispensed into member 192, dispersed and broken up on masked area 196, migrated by the motion/vibration of member 192 to perforated area 198, and cascadingly dispensed across the width (as shown) and length of perforated area 198 into ports 120 of developer housing lower portion 104 (FIG. 1). It is to be understood that the present invention is particularly effective in breaking up, clearing and preventing toner agglomerations, and that many combinations of the disclosed motion/vibration imparting motors and devices, as well as perforated and unperforated, walled or unwalled particle/toner dispersing and migration members, as well as various motion and vibration-inducing devices may be employed in accordance with the present invention.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A developer housing including an apparatus for dispersing particles metered from a hopper and falling in a stream, comprising:

a movable plate positioned below the stream of particles and having an upper surface for contacting the particles; and means operatively associated with the plate for moving the plate so as to disperse the particles contacting the plate relative to a direction perpendicular to the stream of falling particles.

2. The developer housing according to claim 1, wherein the stream of falling particles is substantially perpendicular to the plate.

3. The developer housing according to claim 1, wherein the upper surface of said plate is positioned at an oblique angle relative to the stream of falling particles.

4. The developer housing according to claim 1, wherein said plate moves in directions substantially perpendicular to the stream of falling particles.

5. The developer housing according to claim 1, wherein the upper surface of said plate is substantially rectangular and includes a first end and a second end, wherein the first end of said plate is movably suspended from an elasotmeric member and wherein the second end of the plate is attached to said moving means.

6. The developer housing according to claim 1, wherein the upper surface of said plate includes at least one side wall for preventing particles from falling from an edge of the upper surface of said plate.

7. The developer housing according to claim 1, wherein the upper surface of said plate includes a set of perforations for permitting flowthrough of dispersed particles.

8. The developer housing according to claim 7, wherein the upper surface of said plate includes masked areas for transporting particles to the set of perforations in said plate.

9. The developer housing according to claim 1, wherein the upper surface of said plate includes a wire mesh area for permitting flowthrough of dispersed particles.

10. The developer housing according to claim 1, wherein the upper surface of said plate includes a set of fins for channelizing the dispersion of the particles.

11. The developer housing according to claim 1, wherein said moving means comprises a motor.

12. The developer housing according to claim 1, wherein said moving means comprises a linear motion device.

13. The developer housing according to claim 1, wherein said moving means comprises a piezoelectric member.

14. The developer housing according to claim 1, wherein said moving means comprises a electric vibrator.

15. A printing machine including a developer housing having an apparatus for dispersing particles metered from a hopper and falling in a stream, comprising:

a movable plate positioned below the stream of particles and having an upper surface for contacting the particles; and means operatively associated with the plate for moving the plate so as to disperse the particles contacting the plate relative to a direction perpendicular to the stream of falling particles.

16. The printing machine according to claim 15, wherein the particles are toner.

17. The printing machine according to claim 15, wherein the stream of falling particles is substantially perpendicular to the plate.

18. The printing machine according to claim 15, wherein the upper surface of said plate is positioned at an oblique angle relative to the stream of falling particles.

19. The printing machine according to claim 15, wherein said plate moves in directions substantially perpendicular to the stream of falling particles.

20. The printing machine according to claim 15, wherein the upper surface of said plate is substantially rectangular and includes a first end and a second end, wherein the first end of said plate is movably suspended from an elasotmeric member and wherein the second end of the plate is attached to said moving means.

21. The printing machine according to claim 15, wherein the upper surface of said plate includes at least one side wall for preventing particles from falling from an edge of the upper surface of said plate.

22. The printing machine according to claim 15, wherein the upper surface of said plate includes a set of perforations for permitting flowthrough of dispersed particles.

23. The printing machine according to claim 22, wherein the upper surface of said plate further includes masked areas for transporting toner to the set of perforations in said plate.

24. The printing machine according to claim 15, wherein the upper surface of said plate includes a wire mesh area for permitting flowthrough of dispersed particles.

25. The printing machine according to claim 15, wherein the upper surface of said plate includes a set of fins for channelizing the dispersion of the particles.

26. The printing machine according to claim 15, wherein said moving means comprises a motor.

27. The printing machine according to claim 15, wherein said moving means comprises a linear motion device.

28. The printing machine according to claim 15, wherein said moving means comprises a piezoelectric member.

29. The printing machine according to claim 15, wherein said moving means comprises a electric vibrator.

* * * * *